United States Patent [19]

Donatelli

[11] Patent Number: 4,991,410

[45] Date of Patent: Feb. 12, 1991

[54] METHOD AND APPARATUS FOR IMPROVING CROCHETING PROCEDURES

[76] Inventor: Jean Donatelli, 340 Emerson Way, Sparks, Nev. 89431

[21] Appl. No.: 187,160

[22] Filed: Apr. 28, 1988

Related U.S. Application Data

[63] Continuation of Ser. No. 372,960, Apr. 29, 1982, abandoned.

[51] Int. Cl.[5] ..... D04B 3/04; D04B 3/06

[52] U.S. Cl. ..... 66/1 A; 223/106

[58] Field of Search ..... 66/1 A, 1.5, 1 R, 125; 223/106, 109

[56] References Cited

U.S. PATENT DOCUMENTS

| | | | |
|---|---|---|---|
| 510,509 | 12/1893 | Idol | 223/107 |
| 510,563 | 12/1893 | Casson | 223/107 |
| 996,875 | 7/1911 | Morrison | 223/107 |
| 2,434,609 | 1/1948 | Coffey | 66/125 |
| 2,524,157 | 10/1950 | Beirer | 66/125 |
| 4,037,433 | 7/1977 | Weber | 66/1 A |
| 4,112,711 | 9/1978 | Tripp | 66/1 A |
| 4,370,870 | 2/1983 | Kroh et al. | 66/1 A |

FOREIGN PATENT DOCUMENTS

| | | | |
|---|---|---|---|
| 268159 | of 1928 | United Kingdom | 66/125 |

*Primary Examiner*—Werner H. Schroeder

*Attorney, Agent, or Firm*—Herbert C. Schulze

[57] ABSTRACT

This invention is a unique method and apparatus for improving the techniques employed in crocheting. The method and apparatus are characterized by the utilization of a support means for supporting a supply of crocheting thread and means for guiding such thread through guide means which are mounted on fingers of the person conducting the crocheting process. The method and apparatus are further demonstrative inasmuch as the support means can be a storage and transporting means for the guiding elements and the thread. Additional storage is provided for crocheting needles, and the like. Minimal irritation and injury results in the fingers and hand of the user because of the method and apparatus.

1 Claim, 3 Drawing Sheets

METHOD AND APPARATUS FOR IMPROVING CROCHETING PROCEDURES

CROSS REFERENCE TO RELATED PATENT APPLICATIONS

There are no patent applications filed by me related to the within application except for patent application Ser. No. 06,372,960 filed Apr. 29, 1982, now abandoned, of which this is a continuation application.

BACKGROUND OF THE INVENTION

I. Field of the Invention

This invention is in the general field of aids to the improvement of crocheting procedures. In particular, it is in the field of storing, transporting, and dispensing certain elements that are used in the art of crocheting such as thread supply, thread supply supporting means, guiding means for the thread that is dispensed from the supply means and the guiding of such thread to the implements that weave the thread into an article. The invention is further directed toward the elimination to a great extent of injury and irritation caused by the passage of the thread through fingers of a hand that is used by the operator to direct the thread from the supply to the point of being worked by the crocheting implements that are conventionally used in the aart.

II. Description of the Prior Art

There have been many attempts by persons that are crocheting to eliminate or decrease the irritation and injury to the hand guiding the thread to the article being formed One of the most common methods is the placement of adhesive type tape about the digits of the hand guiding the thread in order that the constant movement and pulling of the thread which brings about the friction that causes most of the problems is somewhat eliminated. This irritation is especially true of persons that suffer from the afflictions to the hands such as rashes and arthritis and many common ailments These conditions are especially aggravated in older persons and those that have very sensitive skin. Allergies contribute to many of such ailments. Metallic threads are often used in the art of crocheting, along with twine and ribbon-like materials. In all of these previous problems that occur, there has not been any technique or use of apparatus that has easily and economically accomplished the elimination of the problems. In this respect, the present invention is completely unique in which the above mentioned problems have been virtually eliminated by the method and apparatus of the inventor.

SUMMARY OF THE INVENTION

I have engaged in a study and experimentation of a lengthy period of time to attempt to alleviate the problems brought about by the art crocheting process.

I have accomplished solutions to those problems by means of the method and apparatus set forth in this application.

I have provided an apparatus for supporting and releasing a length of thread to be led through guide means upon fingers of the hand handling the thread that is eventually led to the crocheting implement and to the workpiece Along with the support means, I have provided storage means for keeping the crocheting implements and thread along with the thread guide means in a neat, safe and easily transportable condition.

Thus it is seen that one of the objects of the invention is to provide a dispensing combination that literally brings the thread from the supply to the point of being worked into an article without causing the amount of wear to the thread and the operator's fingers as is now the case with conventional apparatus and methods of crocheting.

The foregoing and other objects of this invention and advantages of this invention will become apparent to those skilled in the art upon reading the description of a preferred embodiment which follows in conjunction with a review of the appended drawings.

DESCRIPTION OF A PREFERRED EMBODIMENT

Figure 1:
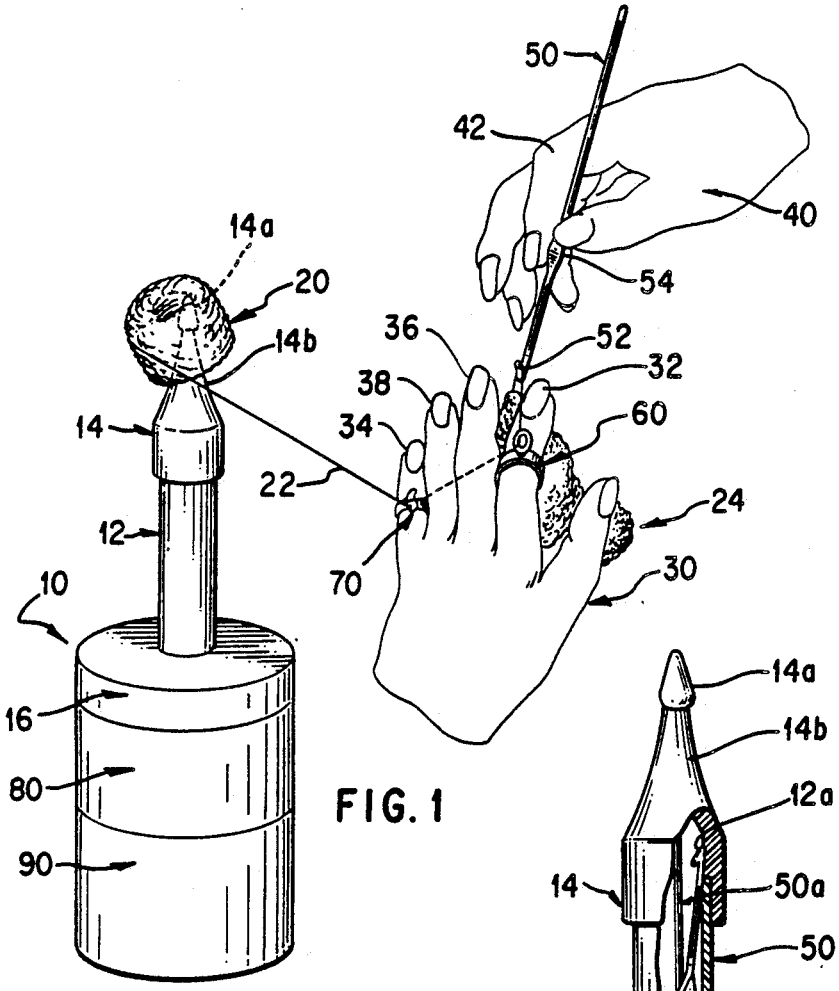
FIG. 1 is a perspective view of the crocheting procedure utilizing components of my invention.

In FIG. 1 I have illustrated a typical crocheting procedure that incorporates elements used in accomplishing the methods and equipment of my invention. A combination container-pedestal 10 is shown supporting a ball of thread 20 for dispensing a thread 22 to a hand 30 of a person that is crocheting. In this instance, the hand 30 is the left hand of the operator and it is to be understood that the right hand 40 can be the receiving hand for first intercepting the thread as it comes off the ball 20 and into the receiving hand of the operator.

A crochet hook 50, as is well known in the art of crocheting, is shown held by the right hand 40 of the person doing the crocheting.

Thread guiding articles 60 and 70 are shown in this view as being placed over the first and fourth fingers 32 and 34 of the operator. Second and third fingers 36 and 38 are shown as guiding digits for the thread as it is drawn from the spool, or ball, 20 to the workpiece 24 by means of the hook portion 52 of the hook element 50. A flat portion of the hook element 50 is shown at 54 to be more easily held from rotation while in the hands of the operator. The upper end 56 is indicated as being pressed against the first finger 42 of the right hand 40 of the crocheter for stability.

Figure 2:
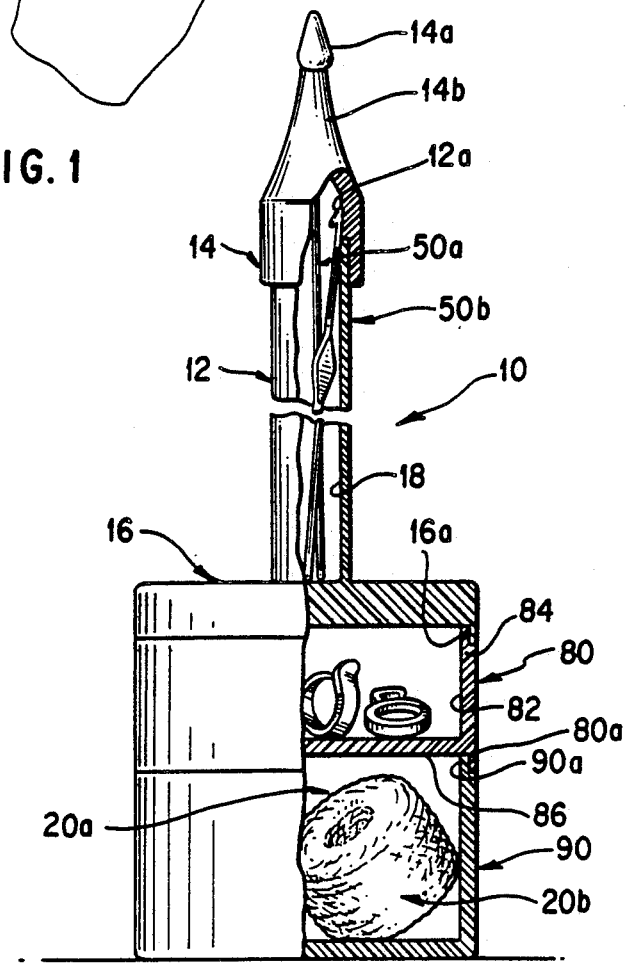
FIG. 2 is an enlarged side elevation, partly in section, of the container-pedestal combination of FIG. 1.

The combination container-pedestal 10 is shown in more detail in FIG. 2 of the drawings. In this instance, the post 12, having a cap portion 14, is shown formed integrally to a base portion 16. A hollow interior crochet hook receiving opening is shown at 18. Crochet hooks 50*a* and 50*b* are shown in stored condition within this opening. It is preferable to allow the hooks to project higher than the uppermost edge 12*a* of the post in order that an operator can more easily retrieve a selected hook from the container after the cap 14 has been removed.

The tip of the cap portion is shown at 14*a* to be of such a configuration so as to support the thread ball 20 upon it in a manner that allows the ball to freely rotate for releasing the thread. A conical surface 14*b* is contoured in such a manner as to allow the free rotation of the ball 20. Such balls of thread are common in the field of thread storage and merchandising.

The base 16 is shown to be solid in construction to provide ballast to the post and its cap. The pedestal can be of conventional construction as is known in the plastics industry it is conceivable, too, that the base can be made of wood or some comparable material in order to provide a more esthetic appearance to the overall procedure of crocheting.

In FIGS. 1 and 2 it can also be seen that a storage container 80 can be provided which has a hollow compartment at 82 forstoring a supply of the thread guiding apparatus of my invention. An upwardly projecting ridge 84 is shown to fit into a corresponding matching groove 16*a* in the base portion 16 of the pedestal portion of the assembly The lower wall 86 is shown at the lower portion of the container 80. Another compartment segment 90 can be added to the overall assembly of the pedestal-container 11 to store balls of different thread balls 20*a* and 20*b*.

Upwardly projecting ridge 90*a* is shown fitting into a corresponding groove portion 80*a* in the lower portion of the bottom wall 86 of the container 80. This allows a convenient storage arrangement for both the balls of thread and the thread guiding members when they are not in use. It also is an arrangement that easily and safely stores the crochet needles 50, and the like.

Figure 5:
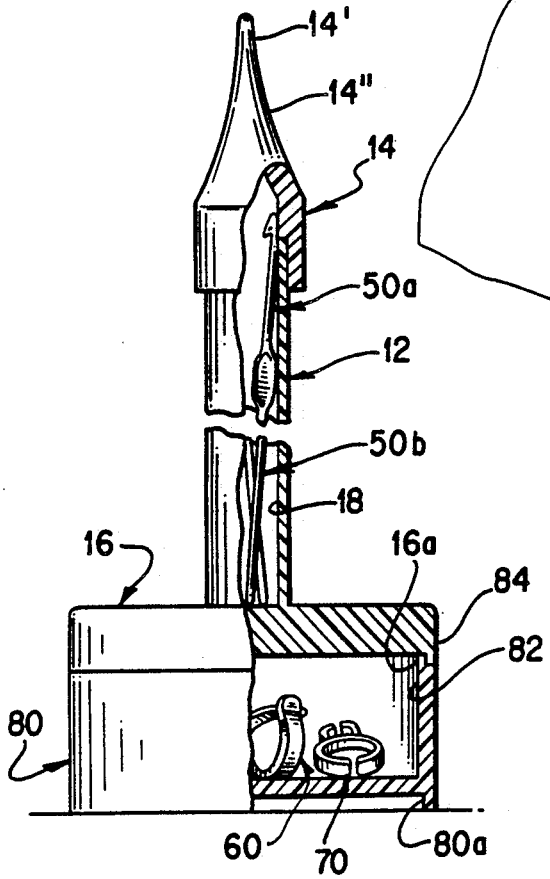
FIG. 5 is a view similar to FIG. 2 showing an alternate container-pedestal combination that may be employed in the method of my invention.

The arrangement shown in FIG. 5 shows the elimination of one of the compartments 80 or 90 in order to fulfill the needs that the operator wishes.

Figure 3:
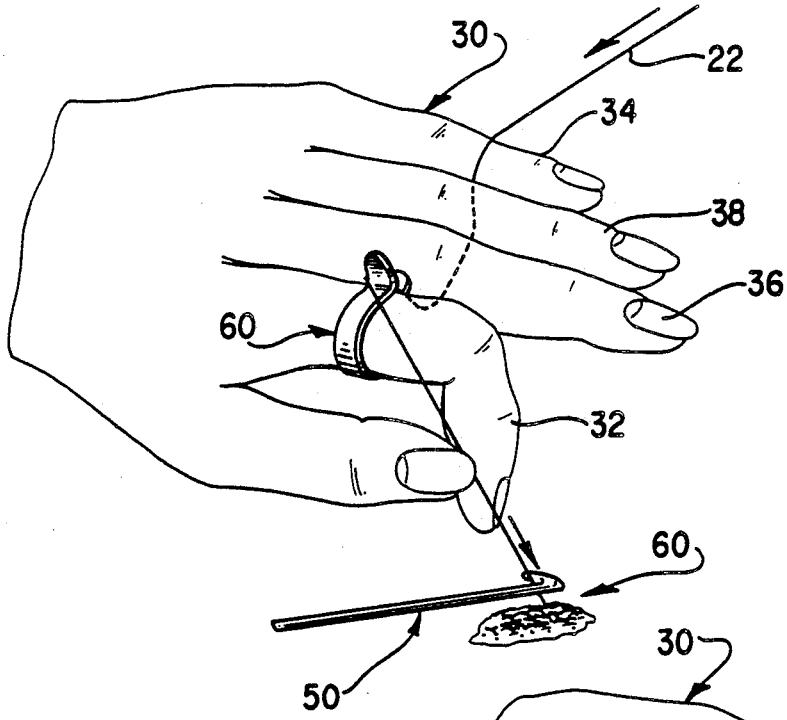
FIG. 3 is a perspective view of one arrangement of guiding thread during a crocheting procedure.
Figure 4:
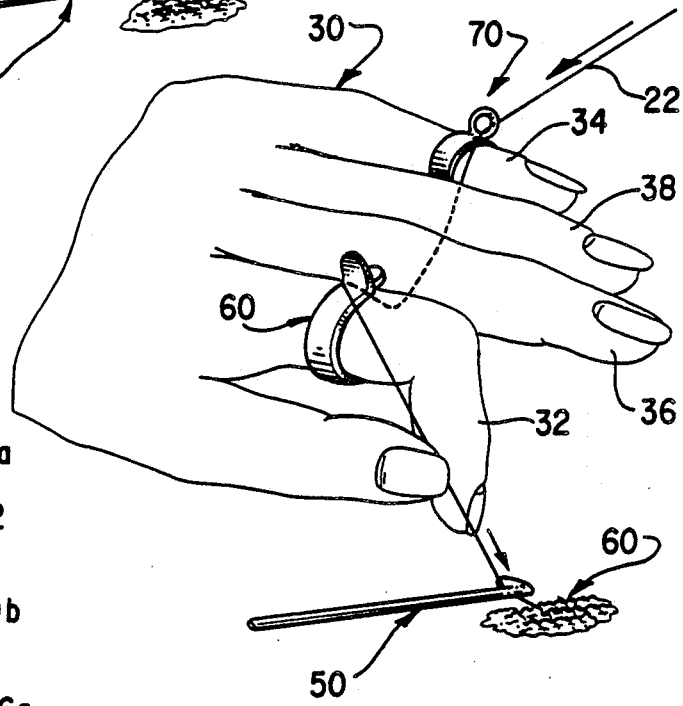
FIG. 4 is a perspective view similar to FIG. 3 but showing an alternate arrangement of the procedure of crocheting.

In FIGS. 3 and 4 I have shown two ways that the thread guiding members are employed in order to practice the advantages of my invention over prior methods of guiding thread in the crocheting process The arrangement in FIG. 3 illustrates the manner in which only one thread guiding member is utilized In this case, the operator allows the thread to weave through the finger arrangement to finally pass through the member 60 which is mounted on finger 32 of the left hand 30. The article 60, in this case, is used to pull the thread from the storage ball 20 without placing a load against the first finger 32 and thus keeps the finger from being injured by abrasive action of the thread passing over the finger The arrangment shown in FIG. 4 is further relieving the abrasive thread action over the fourth finger. The guide element 70, in this case, takes the brunt of the strain of abrasive action of the thread as it is pulled off the supply roll 20. The passing of the thread under the second and third fingers and then again through the guide 60 on the first finger allows the operator to practice the art of crocheting without bringing about the discomfort or injury to the hand directing the thread to the article being formed and off of the supply ball.

In FIGS. 6 through 14 I have shown a variety of thread guiding members that I have designed for use in the method of my invention.

Figure 6:
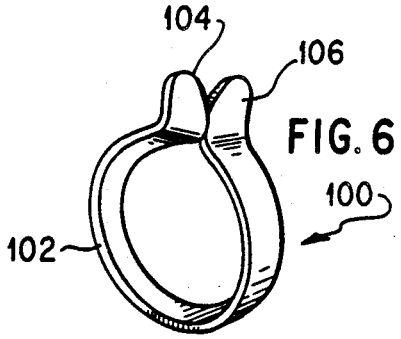
FIG. 6 is a perspective view of one form of thread guide ring devices of my invention.
Figure 7:
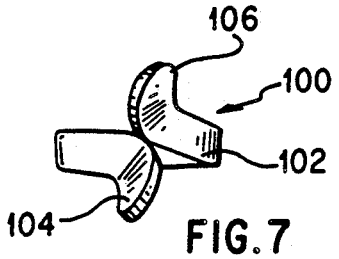
FIG. 7 is a top plan view of the device of FIG. 6.

FIGS. 6 and 7 show a ring assembly 100 which has its main body portion 102 terminating into two wing-like members 104*a* and 104*b* with a gap 106 located therebetween. This ring is easily slipped over a finger and the thread 22 passes about one of the wings, as is shown in the illustration of FIG. 6. The ring is easily compressed or expanded to accommodate the size of the finger of the person doing the crocheting.

Figure 8:
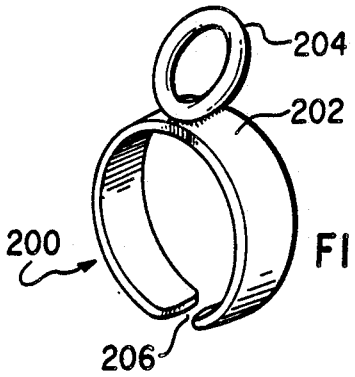
FIGS. 8 through 14 are perspective views of alternate embodiments of guiding devices for practicing the methods of my invention.
Figure 9:
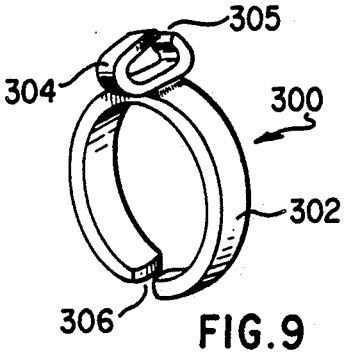

FIG. 8 shows a ring for guiding thread. The ring 200 is shown with a main body portion 202 and an eyelet 204 for guiding thr thread 22. The main body poriton is separated at 206 in order that the ring be adjustable for various sizes of fingers FIG. 9 shows a ring 300 with its main body portion 302. A loop 304 is affixed to the top of the ring and is shown separated a small amount at 305 for permitting the thread 22 to be inserted into the confines of the loop 304. The separation at 306 allows the ring to be adjusted for whatever size finger is encompassed.

Figure 10:
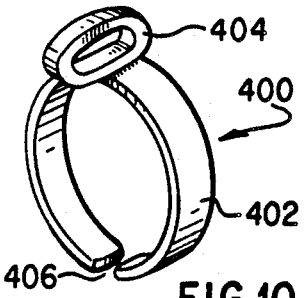

The showing in FIG. 10 illustrates an elongated loop 404 affixed to the main body portion 402 and having the separation at 406. The ring 400, in this case, illustrates the loop 404 as reaching forward a greater distance toward the fingertip for the purpose of more easily bringing the thread 22 forward closer to the workpiece. Persons with arthritis, and the lie, are aided considerably by this forwardly oriented loop design.

Figure 11:
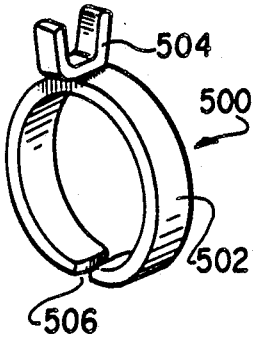

FIG. 11 shows a ring 500, with its main body portion 502, and a yoke 504 affixed to the top thereof. The separation at 506 affords the adjustment of the ring 500 to different sized fingers.

Figure 12:
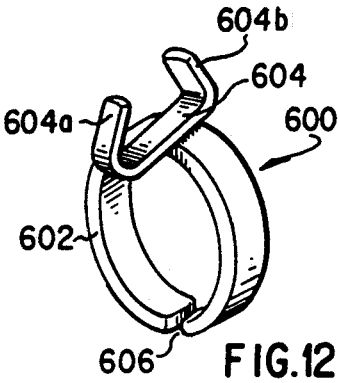

FIG. 12 shows a ring 600, body 602, guide member 604, and separation 606. The member 604 is shown with one part of its base portion extending forwardly toward the fingertip of the operator to aid in guiding thread 22 to the workpiece Angularly disposed tab 604*a* and vertically directed tab 604*b* complete the guide portion of the device. The separation 606 allows the ring to be adjusted to the size of the operator's finger.

Figure 13:
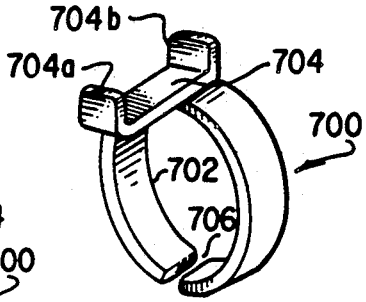

FIG. 13 is a ring 700 having a U shaped guide 704 mounted on the body portion 702. Separation 706 allows the ring to be adjusted to different sizes of fingers. On the forward portion of the guide postion 704 is located a vertically oriented tab portion 704*a*. This projects toward the tip of the finger that is holding the guiding device a greater distance from the main body of the ring to guide the thread 22 toward the workpiece. A second vertically oriented tab 704*b* is shown at the opposite end of the guide portion and serves to guide and retain the thread on the finger.

Figure 14:
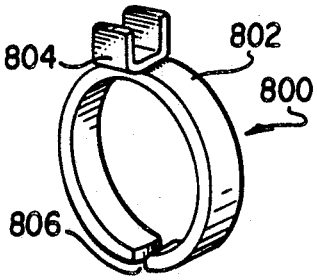

The embodiment shown in FIG. 14 at 800 shows a main body 802 of the ring supporting a guide means 804 at its top. The separation at 806 provides adjustability to the ring for various sizes of fingers.

The embodiments of thread guiding members are especially helpful for the person that is doing the crocheting in that many times there is used a metallic thread for such art, and this thread is especially damaging to the fingers and hands of the operator. Rougher and more caustic threads are often in the form of ribbons or strings which further complicate the ease of performing the art of crocheting. I have found that the thread or thread-like material is guided more quickly through the entwinement of the finger gripping and the process of completing the article being formed is accelerated.

The forwardly directed extensions of the guide portions of the guide elements is especially noted in FIGS. 10, 12 and 13. These configurations especially aid a person with a condition such as arthritis, or the like, into performing the crocheting process without the discomfort often associated with such a process.

Figure 15:
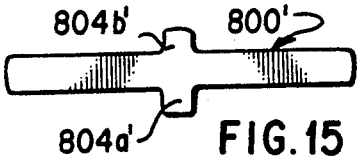
FIG. 15 is a simplified blank from which a guiding means can be fabricated to resemble the article illustrated in FIG. 11 but made from a single strip of material.

FIG. 15 clearly illustrates the simplest form of guide apparatus that can be formed from a simple "U" shaped member being attached to the top of the ring. In FIG. 15 I have illustrated a blank 800' that can be formed into a loop to be placed about a finger. This loop, similar to the loop 802 in FIG. 14, is then placed about a finger. The two tabs 804*a'* and 804*b'* are then bent upwardly by known processes in the plastics industry, to form the "U" portion of the ring. The two outward ends of the strip can be brought together to a point of almost touching one another as is shown in most of the embodiments previously shown, and the ring can then be adjustably arranged to be placed onto a finger size that is to wear the device.

Figure 16:
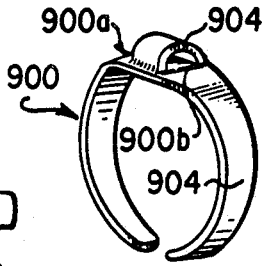
FIG. 16 is a perspective view of yet another alternate embodiment of guiding device as it can be formed from a single strip of material.

The embodiment shown in FIG. 16 very simply shows that the upper portion of the ring element is first slit and then pressed outwardly into the loop shown. In this embodiment, the ring 900 is shown with a loop 904 which is pressed outwardly from a pair of slits 900*a* and 900*b* until the loop has reached the size necessary to direct the thread toward the workpiece. This procedure can be done while the plastic material has been heated and is easily worked.

I have found that the breakage of the threads that are led from the spool to the workpiece is greatly diminished by the use of the smooth pulling surfaces of the guiding devices.

The construction and design of the easily worn and adjustable thread guiding members allows the guiding members to be affordable by elderly persons who are limited by income and who are usually unable to pay for the additional costs that are brought about by the injury or inflammations caused by such therapeutic arts such as crocheting.

I have shown in FIG. 5 that the tip support area 14' to be a simplified protrubance for supporting a supply of thread and that the sloping sides 14'' can then flare out to the exterior diameter of the cap portion 14.

While the embodiments of this invention shown and described are fully capable of achieving the objects and advantages desired, it is to be understood that such embodiments are for the sole purpose of illustration and not for the purpose of limitation.

I claim:

1. An apparatus for improving crocheting procedures which comprises: a support means for supporting a crocheting thread supply means, said support means being an elongated vertically disposed rod member terminating in an enlarged and then reducing to a pointed upper end suitable for supporting a ball of crocheting thread in such manner as to cause said ball to be resting at an angular relationshiP to said elongated rod; a base means upon which said rod is mounted, base means comprising a hollow round compartment, crocheting implements located within said round hollow compartment; a first guide means cooperative with thread being removed from the ball of crocheting thread located on said pointed member at an angular relationship thereto which guide means consists of ring for a finger and means to guide the direction of thread from the ball, and wherein a second guide means is mounted upon another finger for guiding said thread being removed from said ball in a different direction from the original first guide means.

* * * * *